United States Patent [19]

Suzuki et al.

[11] Patent Number: 5,011,126

[45] Date of Patent: Apr. 30, 1991

[54] AUTOMATIC SHEET STACK LOADING MECHANISM OF SHEET FEEDING APPARATUS

[75] Inventors: Daiji Suzuki, Yokohama; Yasuhiro Sudo, Shinjuku, both of Japan

[73] Assignee: Dai Nippon Insatsu Kabushiki Kaisha, Tokyo, Japan

[21] Appl. No.: 376,621

[22] Filed: Jul. 7, 1989

[30] Foreign Application Priority Data

Jul. 13, 1988 [JP] Japan ..... 63-172694

[51] Int. Cl.[5] ..... B65H 7/02

[52] U.S. Cl. ..... 271/227; 271/30.1; 271/159; 271/240; 271/241; 414/795.8; 414/795.7; 414/796; 414/796.7

[58] Field of Search ..... 271/30.1, 31, 146–148, 271/157–159, 168, 171, 226–227, 234, 240–241, 248, 250, 221; 414/795.8, 795.7, 796, 796.7

[56] References Cited

U.S. PATENT DOCUMENTS

| | | | |
|---|---|---|---|
| 2,336,839 | 12/1943 | Blackstone | 271/158 X |
| 4,768,913 | 9/1988 | Baba | 271/159 X |
| 4,811,939 | 3/1989 | Keith | 271/227 X |

FOREIGN PATENT DOCUMENTS

| | | | |
|---|---|---|---|
| 521061 | 1/1956 | Canada | 271/30.1 |
| 1099556 | 2/1961 | Fed. Rep. of Germany | 271/159 |
| 0077134 | 5/1982 | Japan | 271/159 |
| 0081721 | 3/1989 | Japan | 271/241 |

*Primary Examiner*—Robert P. Olszewski
*Assistant Examiner*—Boris Milef
*Attorney, Agent, or Firm*—Wegner, Cantor, Mueller & Player

[57] ABSTRACT

An automatic sheet stack loading mechanism of a paper sheet feeding apparatus has a main lift for supporting a stack of sheets to be fed thereon. The main lift is incrementally moved upwardly to place the uppermost sheet of the stack at a predetermined height position with respect to a sheet separator disposed over the stack and operating to separate the sheets one by one from the stack. When the stack of sheets is consumed considerably, parallel horizontal spits are inserted under the stack from both transverse sides of the stack thereby to support the load of the stack and to enable the main lift to be lowered to receive a new stack of the sheets. The insertion of the spits in the transverse direction of the stack is advantageous in that the central portion of the sheets of the stack along the direction of feed of the sheets is maintained at constant height irrespective of downward deflection of the spits so that adjustment in position of the sheet separator is not required.

5 Claims, 7 Drawing Sheets

AUTOMATIC SHEET STACK LOADING MECHANISM OF SHEET FEEDING APPARATUS

BACKGROUND OF THE INVENTION

The present invention relates to a sheet feeding apparatus for a printing press, a punching machine or the like, for feeding sheets of paper one at a time from a stack of the sheets to a printing or punching unit, and more particularly to an automatic mechanism for loading a new stack of sheets.

A typical conventional paper sheet feeding apparatus comprises a main lift for elevating a pallet upon which is placed a stack of paper sheets to be fed to a printing press, a punching machine or the like. A sheet separator is installed over the stack of sheets which has been elevated to a predetermined position, to separate the uppermost sheet one by one. When the sheets of the stack have been fed considerably, a new stack of sheets must be loaded. In the known art, the loading of a new stack is carried out by manually inserting a plurality of parallel spits under the old stack of sheets, which has been consumed considerably, to support the old stack from below, and the main lift is lowered to receive the new stack of sheets thereon. The parallel spits are supported in cantilever fashion by an auxiliary lift.

The lowered main lift supporting the new stack of sheets thereon is then elevated until the uppermost sheet of the new stack is brought into abutment with the undersides of the spits. Thereafter, the spits are retracted so that the old stack which has been supported by the spits is placed on the new stack.

In the conventional paper sheet feeding apparatus described above, the spits extend and are advanced and retracted in the direction of feed of the sheets. When these spits are supporting the old stack, they deflect downwardly due to the load of the stack. It will be understood that the downward deflection of the spits is increased toward the tip ends thereof since the spits are supported by the auxiliary lift in cantilever fashion. This is undesirable because the stack of sheets supported by the spits are caused to have an upper surface inclined downwardly in the direction of feed of the sheets, as the surface extends from its position over the proximal ends of the spits to its position over the tip ends thereof, and because the sheet separator fixed at a predetermined position over the stack of sheets has different relative position relative to the uppermost sheet of the stack in the direction of feed the sheets. It will be apparent that this affects adversely to the sheet separating function of the sheet separator as well as to the sheet feeding operation, as will be described hereinafter in more detail, and that this necessitates readjustment of the position of the sheet separator as well as skill of the operator during the operation of the sheet feeding apparatus.

The present invention was made to solve the above and other problems encountered in the conventional sheet feeding apparatus and has for its object to provide an automatic sheet stack loading mechanism of a sheet feeding apparatus wherein the downward deflection of the stack of sheets does not adversely affect the sheet separating and feeding operation.

SUMMARY OF THE INVENTION

According to the present invention, the object stated above is attained by an automatic sheet stack loading mechanism of a sheet feeding apparatus, comprising a main lift for supporting thereon a stack of sheets to be fed, a sheet separator disposed over the main lift to act on the uppermost sheet of the stack of the sheets so as to separate the sheets one by one from the stack, said main lift being movable upwardly to bring the uppermost sheet of the stack thereon to a predetermined height position relative to the sheet separator, and horizontally extending parallel spits for insertion under the stack of sheets supported by the main lift to support the load of the stack from below thereby to enable the main lift to be lowered to receive a new stack of sheets thereon while the uppermost sheet of said first mentioned stack is held at said predetermined height position, said mechanism being characterized by comprising a pair of vertically movable carriage means disposed at both sides of the main lift with respect to the direction transverse to the direction of feed of the sheets from said first mentioned stack, each of said carriage means carrying thereon the parallel spits in such a manner that the spits extend in said transverse direction and are shiftable toward and away from the stack on the main lift, and motive means for shifting the spits toward and away from the stack on the main lift.

According to the present invention, downward deflection of the stack of sheets supported on the spits occurs along the central portion of the sheets in the direction of feed of the sheets, and the deflected central portion is not inclined and is held at a constant height with respect to the direction of the feed of the sheets. For this reason, it is not necessary to adjust the height of the sheet separator, and the feed of sheets is made in good order.

A preferred embodiment of the present invention will be described below with reference to the accompanying drawings.

BRIEF DESCRIPTION OF THE ACCOMPANYING DRAWINGS

DETAILED DESCRIPTION OF THE PREFERRED EMBODIMENT

Prior to the detailed description of the present invention, a typical conventional paper sheet feeding apparatus will be described for better understanding of the advantageous features of the present invention in comparison with the conventional apparatus.

Figure 8:
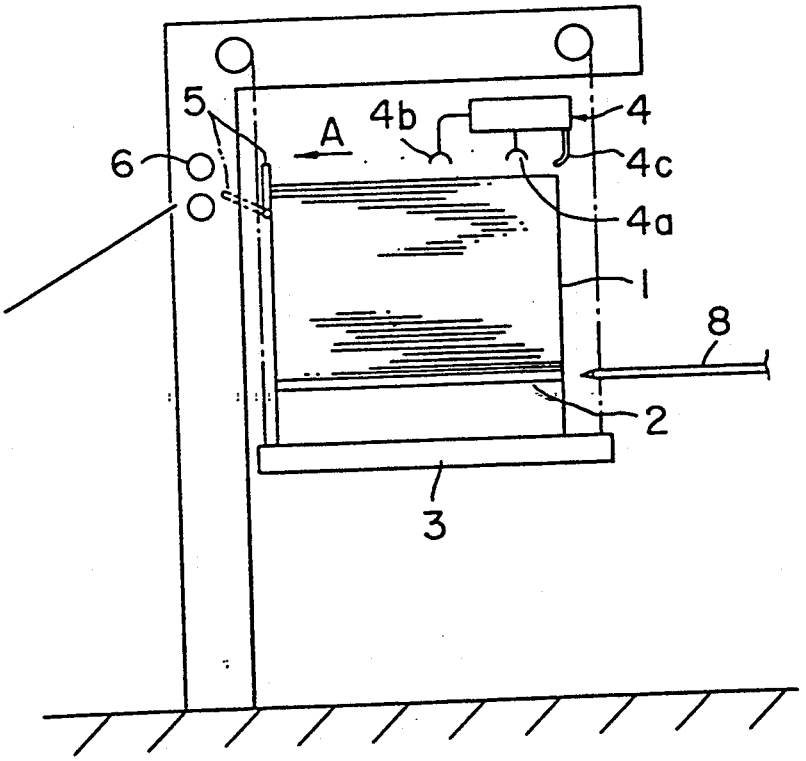
FIG. 8 PRIOR ART
FIG. 8 is a schematic side view of a conventional sheet feeding apparatus.

As shown in FIG. 8, the typical conventional paper sheet feeding apparatus for printing presses, punching machines or the like comprises a main lift 3 for vertically moving a drain-board-like pallet 2 (having multiple parallel grooves in the upper surface) upon which is placed a stack 1 of paper sheets; a sheet separator 4 including vacuum suction pads 4*a* and 4*b* and an air blowing pipe 4*c* for separating the uppermost paper sheet from the stack 1 of sheets and for feeding the separated paper sheet in the direction indicated by an arrow A; an elevator mechanism (not shown) for upwardly moving the main lift 3 in such a way that the uppermost paper sheet of the stack 1 of sheets is maintained at a predetermined height position with respect to the separator 4; a front plate 5 for controlling the position of the leading edge of the uppermost paper sheet; and a pair of feeding rollers 6 for feeding the uppermost paper sheet which has separated from the stack 1 of sheets in the manner described above. The separator 4 operates to separate only the uppermost sheet from the stack 1 of sheets and then feeds it in the direction indicated by the arrow A while the front plate 5 is retracted to the position indicated by the two-dot chain lines. The pair of feeding rollers 6 nips and feeds the uppermost paper sheet separated and fed in the manner described above while the main lift 3 is elevated to cause the second uppermost paper sheet of the stack of sheets to move to the above-mentioned predetermined height position with respect to the separator 4.

Figure 9:
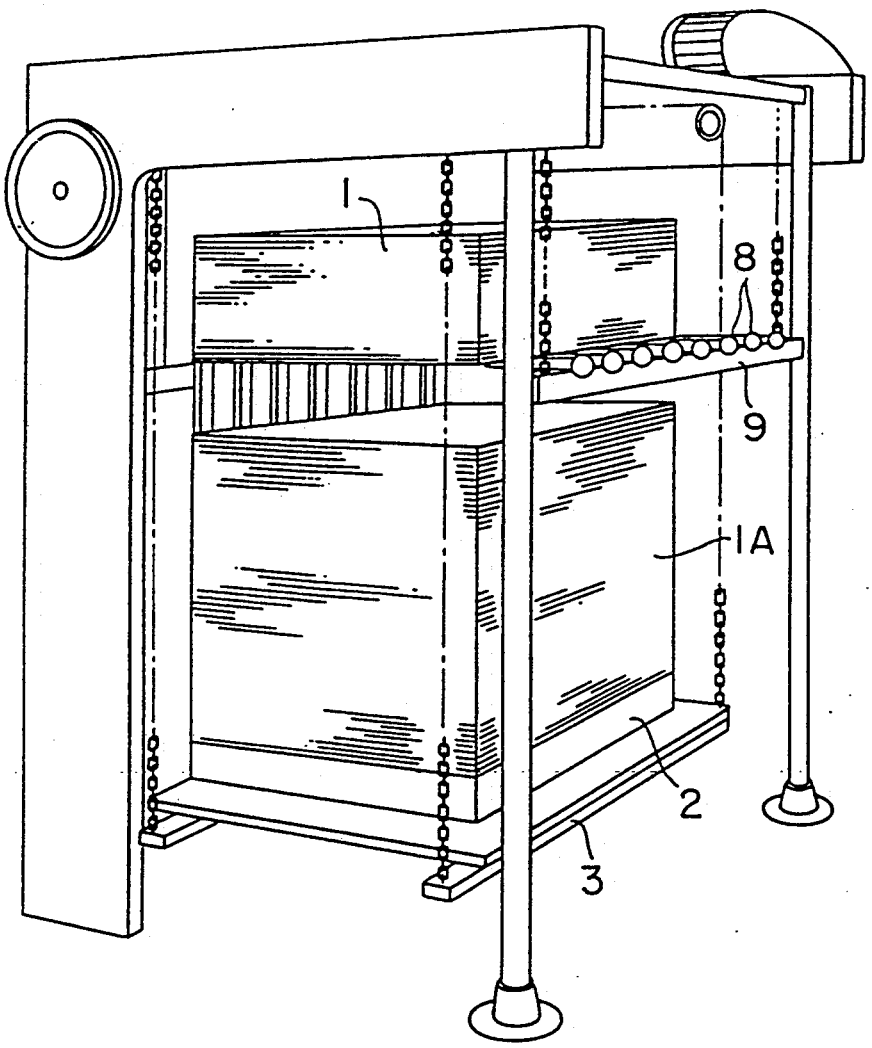
FIG. 9 PRIOR ART
FIG. 9 is a perspective view illustrating the manner of loading a new stack of sheets in the apparatus shown in FIG. 8.

In the sheet feeding apparatus of the type described above, when the number of paper sheets 1 stacked on the pallet 2 reaches a predetermined number, the operator inserts a plurality of parallel spits 8 into respective parallel grooves formed in the upper surface of the pallet 2 in the direction of the feed of the sheets, and the spits 8 are maintained in their predetermined height positions by means of auxiliary lifts provided at the upstream and downstream sides of the sheet feeding apparatus. Under the above-described conditions, the main lift 3 is then lowered and the pallet 2 is removed. Thereafter, a new stack 1A of paper sheets is loaded on the main lift 3 as shown in FIG. 9. The stack 1 of paper sheets is now supported by the auxiliary lifts 9 through the spits 8 while the paper sheet feeding operation is carried out continuously by the separator. Supporting the new stack 1A of paper sheets, the main lift 3 is elevated until the uppermost paper sheet of the new stack 1A of sheets is brought into contact with the undersides of the spits 8. Thereafter, the spits 8 are withdrawn out of the feeding apparatus so that the old stack 1 of sheets is now placed on the new stack 1A of sheets thus loaded. Thus, the operation for loading a new stack of sheets is accomplished.

In the conventional paper sheet feeding apparatus described above, the operation of inserting and withdrawing the spits is carried out manually so that there arises a problem that at least one operator must engage solely in the sheet feeding operation.

Figure 10:
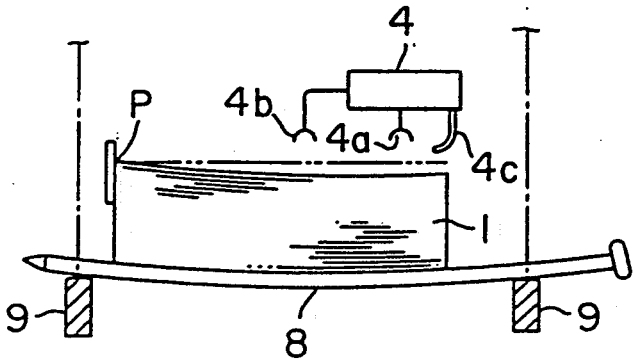
FIG. 10 PRIOR ART
FIG. 10 is an exaggerated side view illustrating the state of supporting a stack of sheets by spits in the conventional apparatus shown in FIG. 8.

Furthermore, as best shown in FIG. 10, the spits 8, which are inserted in the direction of the feed of the sheets so as to support the stack 1 of sheets, tend to deflect downwardly, so that the portion of the upper surface of the uppermost sheet 1 in opposing relationship with the separator 4 becomes lower than a reference position P at the midpoint between the ends of the leading edge of the uppermost sheet 1. As a result, in order to maintain the reference position P at a predetermined height, the adjustment of the position of the separator must be made. Moreover, during and after the piling of the old and new stacks 1 and 1A of sheets and the withdrawal of the spits, unless the amount of drop of the old stack 1 of sheets is made very small, the vacuum suction cups 4*a* and 4*b* and the air blowing pipe 4*c* of the separator 4 cannot take the correct height position relative to the uppermost sheet of the old stack 1 of sheets. As a result, there arise the problems that the sheets are fed with incorrect orientation into the printing press or punching machine and that in response to detection of incorrect sheet feeding by the printing press or punching machine, the operation of the latter is interrupted. Therefore, the operation of loading a new stack of sheets is greatly influenced by skillfulness and experience of the operator, and various incorrect feeding operations occur depending upon the difference in skill and experience among the operators. Consequently, the incorrect feeding operation is one of the factors which much adversely affects the productivity.

The above stated problems are solved by the present invention which will be described below.

Figure 1:
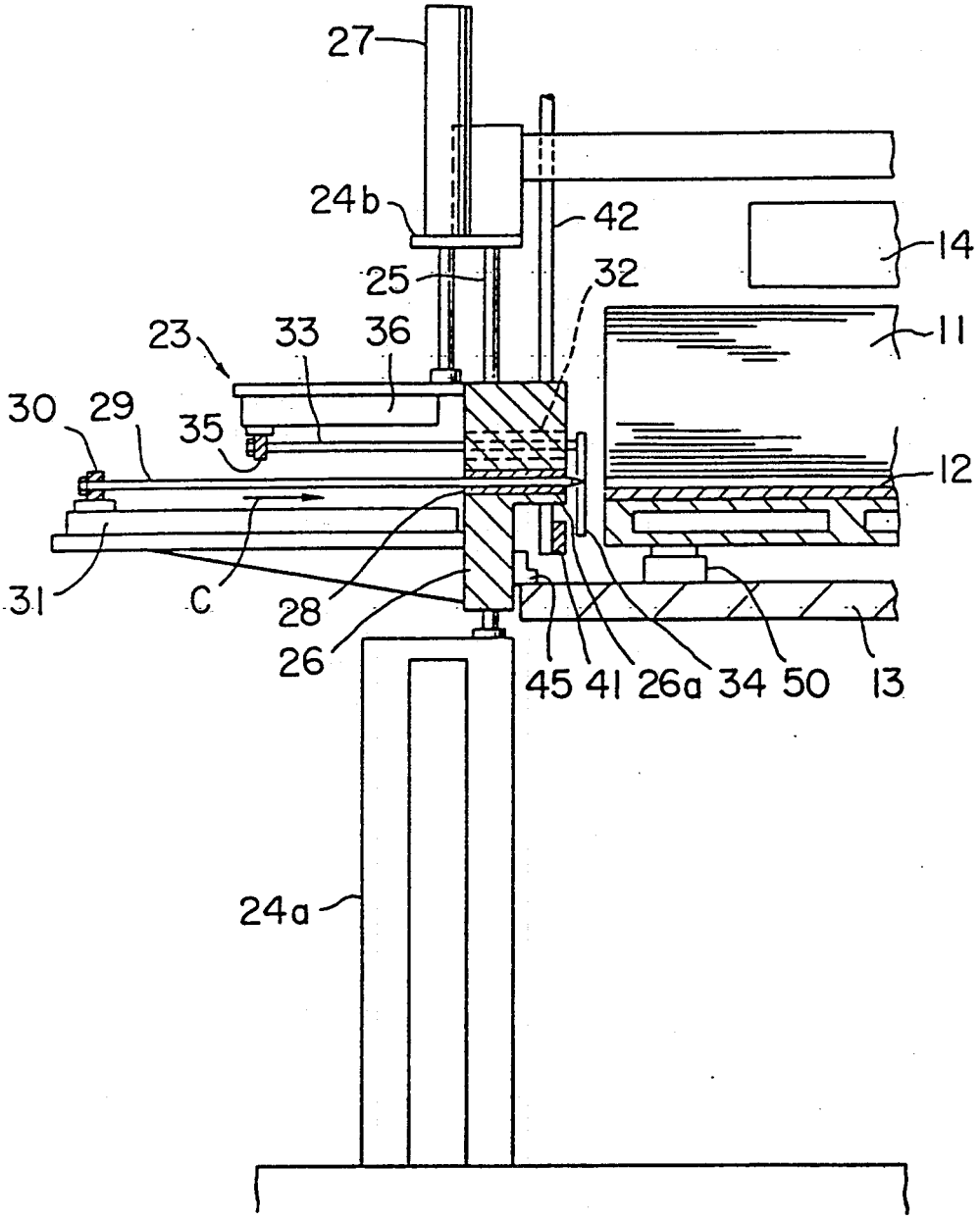
FIG. 1 is a fragmentary front view, partly in section, of a preferred embodiment of a sheet stack loading mechanism of a sheet feeding apparatus in accordance with the present invention.

FIG. 1 is a front sectional view of a preferred embodiment of the automatic sheet stack loading mechanism of a paper sheet feeding apparatus, according to the present invention. Reference numeral 11 represents a stack of paper sheets, which is supported by a drain-board-like pallet 12 having parallel grooves in the upper surface thereof. Reference numeral 13 represents a main lift upon which is mounted the stack 11 of paper sheets and the pallet 12. The main lift 13 is adapted to move upwardly or downwardly. Above the uppermost sheet of the stack 11 there is provided a sheet separator 14 for separating the uppermost paper sheet upwardly from the stack 11 of sheets to feed it to a predetermined position. The main lift 13 is coupled through main lift chains 15 (See FIG. 2) to an elevator mechanism (not shown), which causes the main lift 13 to move upwardly in such a way that as the uppermost sheet is separated from the stack 11 and is fed to a predetermined position, the next uppermost sheet of the stack 11 is brought to a predetermined height position with respect to the separator 14.

Figure 2:
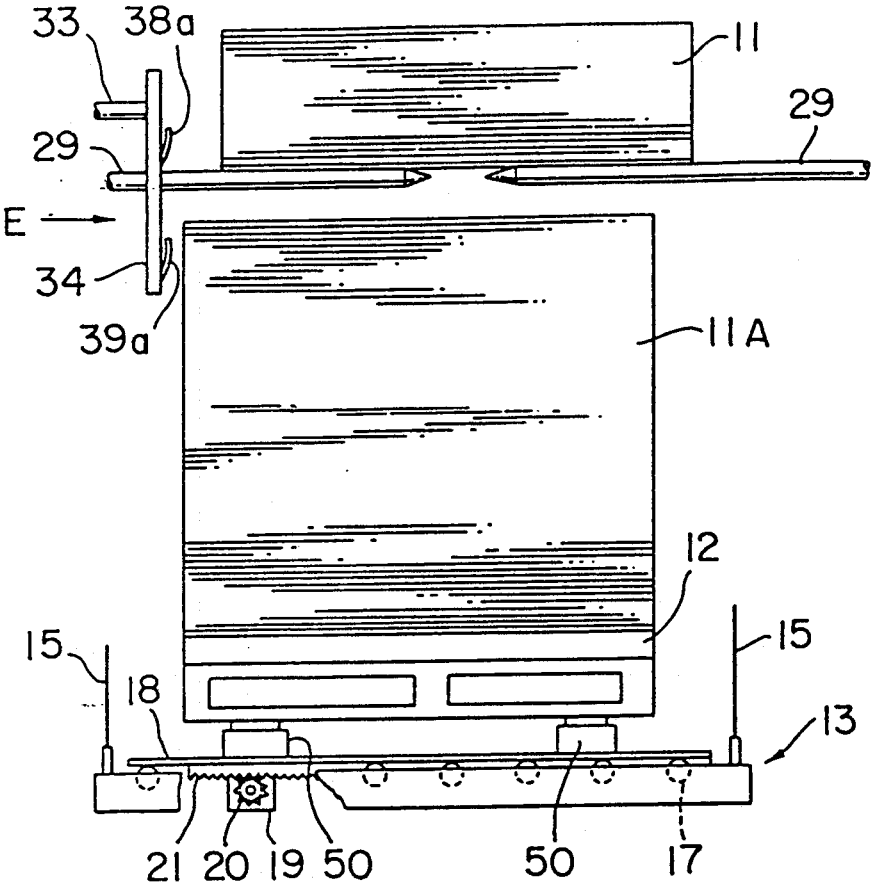
FIG. 2 is a front view illustrating the major component parts thereof.

As best shown in FIG. 2, the main lift 13 has a bottom plate 18 which is supported by rollers 17 to be movable to the right or left as viewed, a motor 19 for moving the bottom plate 18 to the right or left, a pinion 20 on the driving shaft of the motor, and a rack 21 in mesh with the pinion 20. Therefore, the position of the stack 11 of paper sheets mounted on the plate 18 can be suitably adjusted with respect to the transverse direction as will be described in more detail hereinafter.

Referring back to FIG. 1, spit insertion mechanisms 23 (only one is shown in FIG. 1) are disposed at both sides of the stack 11 of sheets on the main lift 13. Each spit insertion mechanism 23 has a pedestal 24*a* erected upright on a floor, a stand 24*b* which is attached to a machine frame above the pedestal 24*a*, a vertical guide shaft 25 which is securely attached to the pedestal 24*a* and the stand 24*b*, a carriage 26 which is vertically movable along the guide shafts 25, and a balancer pneumatic cylinder 27 which supports the vertically movable carriage 26 in such a way that the carriage 26 may be lightly moved upwardly or downwardly, as well as the weight of various component parts mounted on the carriage 26.

Figure 3:
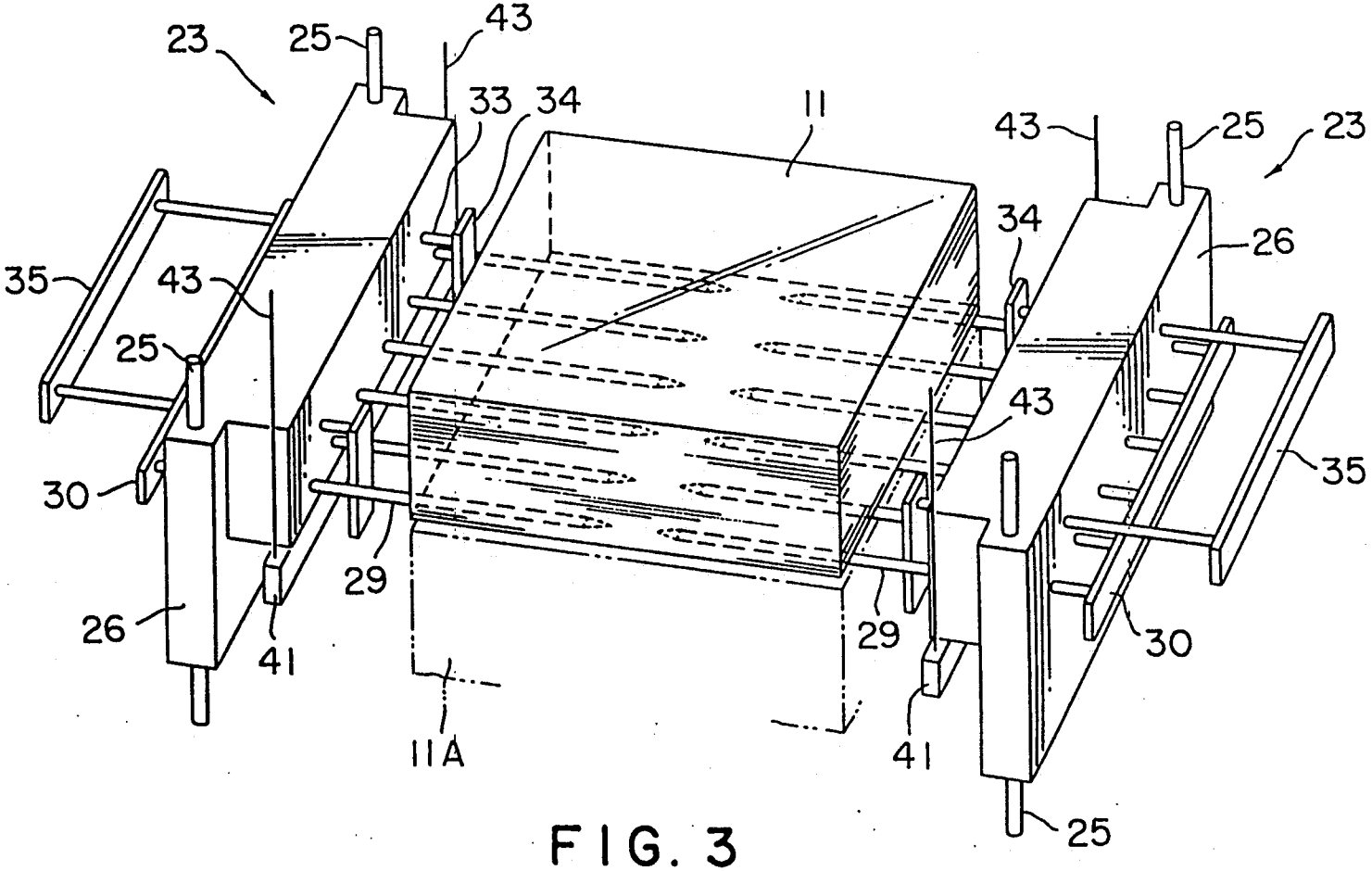
FIG. 3 is a perspective view illustrating major component parts thereof.

As shown in FIG. 3, the vertically movable carriage 26 has a plurality of horizontal stack holding spits 29 each of which is supported by a slide bearing 28 (FIG. 1) for slidable movement in the horizontal direction. As shown in FIG. 1, there is provided a connecting member 30 to which are attached the proximal ends of the spits 29. There is further provided a sliding cylinder 31 for reciprocating the spits 29 through the connecting member 30 in the direction toward and away from the stack 11 of sheets. The sliding cylinder 31 constitutes a spit driving mechanism which reciprocates the sheet supporting spits 29 between their retracted positions spaced apart by a suitable distance from one side edge of the stack 11 of sheets and their advanced positions at which they support the load of the stack 11 of sheets from below.

Figure 4:
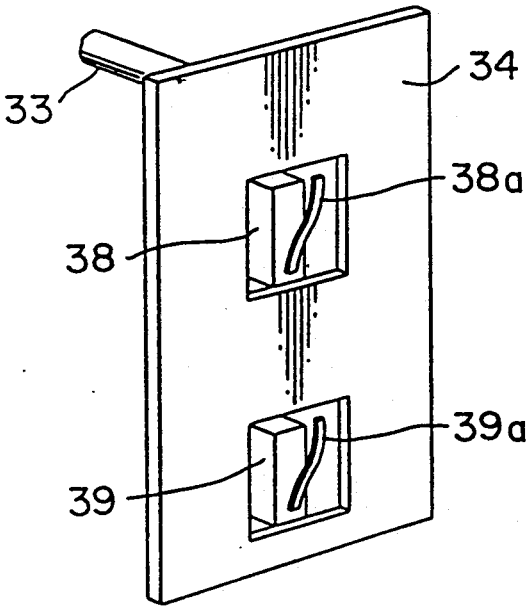
FIG. 4 is a perspective view illustrating a sheet pressing device used in the preferred embodiment shown in FIGS. 1–3.

FIGS. 2 and 4 show a plate-shaped sheet pressing device 34 which has sheet-detection limit switches 38 and 39 disposed at positions, respectively, above and below the spits 29 in such a way that their detecting members 38*a* and 39*a* project beyond the inner surface of the sheet pressing device 34. Pressing device 34 is moved by motive power means 36.

Referring to FIGS. 1 and 3, an auxiliary lift 41 is suspended in opposing relationship with each side face of the stack 11 of sheets, by means of chains 43 (See FIG. 3) passed within auxiliary hollow guides 42 (See FIG. 1). Each auxiliary lift 41 is disposed at a position at which it can abut against and support the undersurface 26*a* of an inward projection extending from the carriage 26 which supports the sheet supporting spits 29. The chains 43 are connected to a lifting motor mechanism (not shown), and, as best shown in FIG. 3, when the auxiliary lifts 41 support from below the stack 11 of sheets through the carriage 26 and the sheet supporting spits 29, the uppermost sheet of the stack 11 is successively brought to a position at a predetermined height with respect to the separator 14 due to successive incremental upward movement of the auxiliary lifts 41.

Referring to FIG. 1 again, a protrusion 45 is formed on the inner side surface of the carriage 26 in opposing and interfering relationship with the main lift 13 so that when the main lift 13 is upwardly moved to the position indicated in FIG. 1, the carriage 26 receives upward moving force through the protrusion 45. The position of the protrusion 45 is so selected that when the carriage 26 is supported through the protrusion 45 by the main lift 13, the sheet supporting spits 29 are in alignment with respective grooves of the pallet 12 for receiving the spits 29 into the grooves of the pallet.

Figure 5:
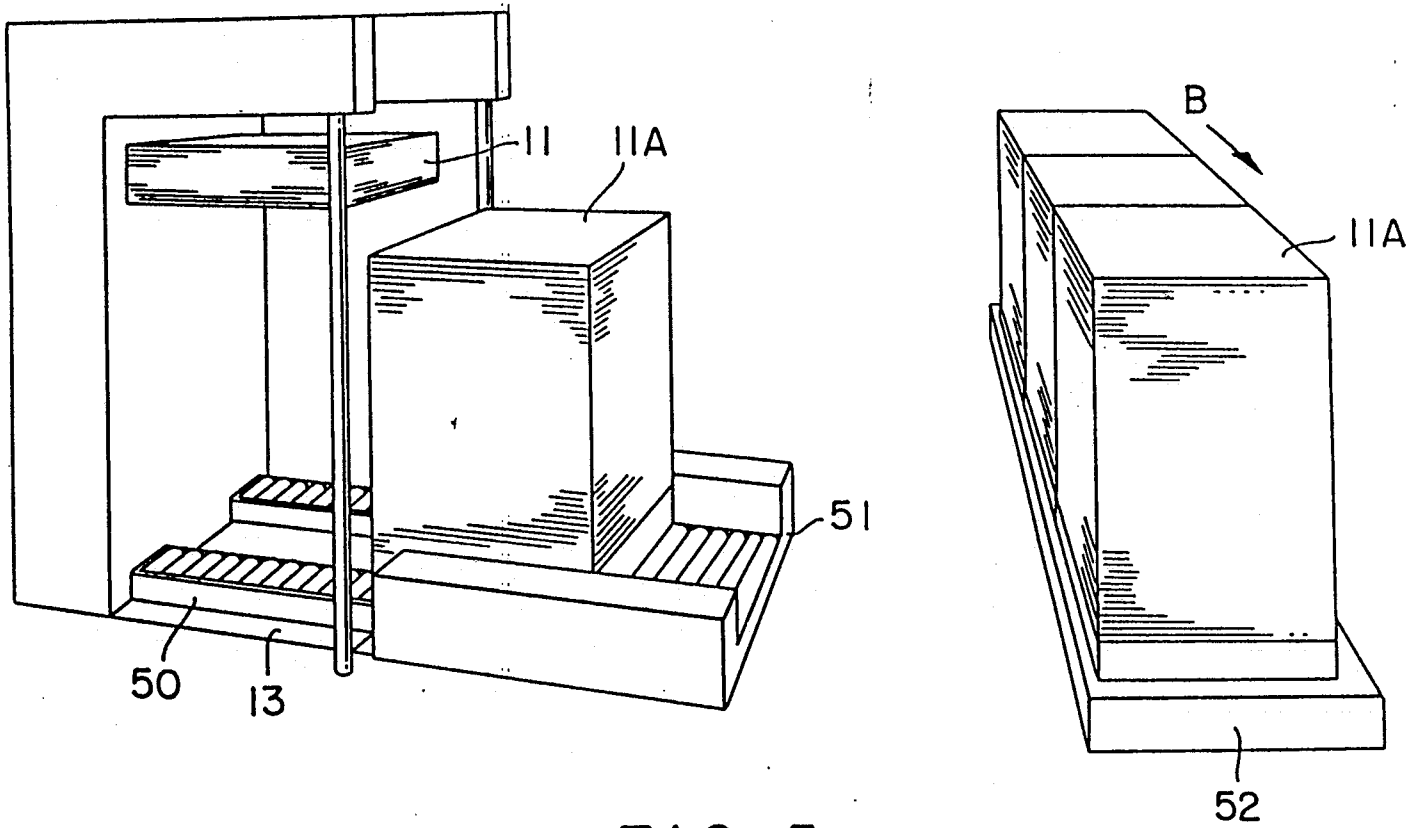
FIG. 5 is a schematic perspective view illustrating a general arrangement of the sheet feeding device used in the preferred embodiment of the present invention.

FIG. 5 is a schematic perspective view illustrating the general arrangement of a device used to load a stack of sheets upon the main lift 13. The main lift 13 has roller conveyors 50 thereon. Reference numeral 51 indicates a traverser 51 with a roller conveyor; and 52, a stand upon which are place a plurality of stacks 11A of sheets. These stacks 11A of sheets are loaded one at a time from the stand 52 through the transverser 51 onto the main lift 13. The stack stand 52 is sequentially moved in the direction indicated by an arrow B as one stack is loaded on the main lift so that a plurality of stacks of sheets can be continuously loaded on the main lift one by one.

Next, referring to FIGS. 6A–6J, sequential steps of loading a stack of sheets by the mechanism with the above described construction will be explained.

Figure 6A:
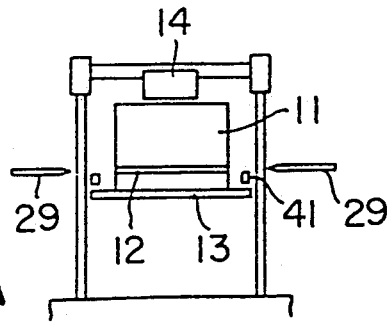
FIGS. 6A to 6J are diagrammatic views for explaining the successive steps of operation of the preferred embodiment.

In FIG. 6A, the main lift 13 upon which is supported the stack 11 of sheets 11 is upwardly moving, and the uppermost sheet of the stack 11 of paper sheets is separated one by one and fed to a predetermined position. In this condition, the stack supporting spits 29 are maintained in their retracted positions, at which they do not contact with the side faces of the stack 11. The auxiliary lifts 41 are also maintained at their inoperative positions.

Figure 6F:
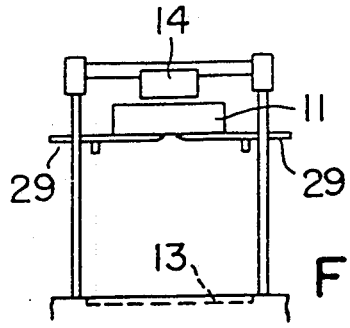
Figure 6B:
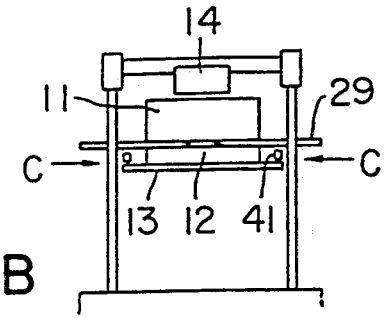

Referring to FIG. 6B, when the main lift 13 is moved upwardly, it abuts against and raises the protrusions 45 as shown in FIG. 1 so that thereafter the carriages 26 are caused to move upwardly in unison with the upward movement of the main lift 13. When the main lift 13 reaches a predetermined height, a sensor (not shown) detects the main lift 13 raised to the predetermined height and energizes the sliding cylinders 31 so that the spits 29 are shifted in the transverse directions indicated by the arrows C to the both sides of the stack 11 of sheets and slidingly inserted into the grooves in the upper surface of the pallet 12 immediately below the lowermost sheet of the stack 11.

Figure 6G:
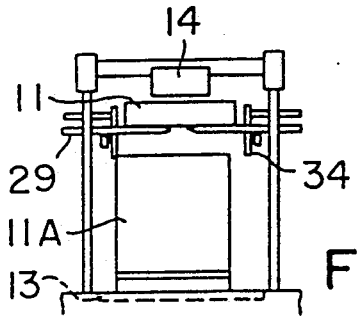
Figure 6C:
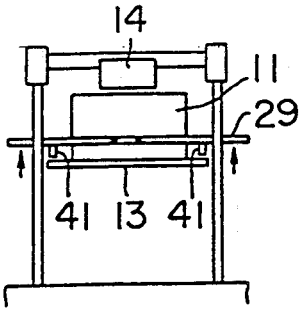

Thereafter, as shown in FIG. 6C, the auxiliary lifts 41 are moved upwardly to support the spits 29 through the carriages 26 (See also FIG. 3) so that the stack 11 of sheets are supported through the sheet supporting spits 29 by the auxiliary lifts 41. After that, the upward movement of the auxiliary lifts 41 is so controlled that the uppermost sheet of the stack 11 is brought to a predetermined height position with respect to the sheet separator 14. It therefore follows that the auxiliary lifts 41 are moved upwardly depending upon the number of sheets which have been separated from the stack 11 and fed to a predetermined position.

When the spits 29 support the stack 11 of sheets, they tend to deflect downwardly depending upon the weight of the stack. According to the present invention, the spits 29 are inserted from both sides of the stack 11 with respect to the direction transverse to the direction of feed of the sheets so that even when the spits are deflected downwardly with the result that the center portion of each sheet of the stack 11 becomes downwardly concave, the height of the center portion of each sheet is maintained at a predetermined height in the direction of feed of the sheet. As a result, unlike the conventional mechanism for loading a stack of sheets described before with reference to FIG. 10, it is not necessary to adjust the height of the sheet separator 14.

Figure 6H:
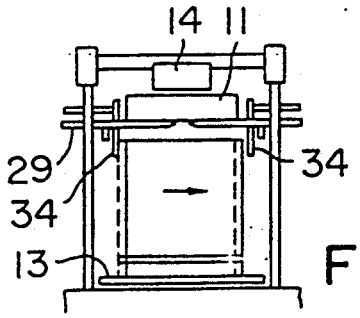
Figure 6D:
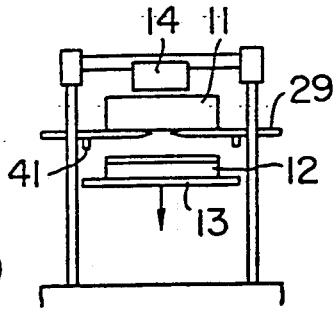

As shown in FIG. 6D, while the stack 11 of sheets is supported by the spits 29 which in turn are supported by the auxiliary lifts 41 and while each sheet of the stack 11 is separated and fed to a predetermined position, the main lift 13 with the empty pallet 12 thereon is moved downwardly.

Figure 6I:
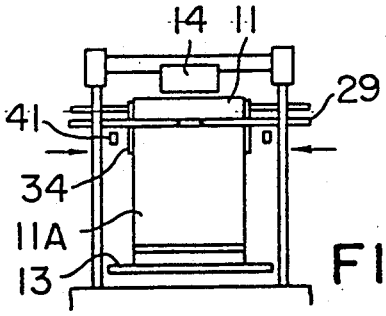
Figure 6E:
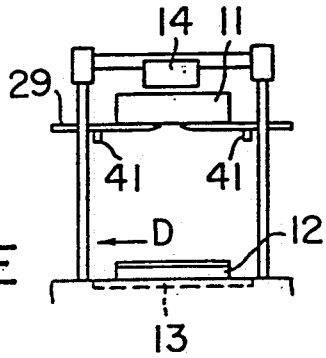

As shown in FIGS. 6E and 6F, the main lift 13 is moved down to the lower end of its stroke, and the pallet 12 is removed in the direction indicated by an arrow D by a suitable device or manually.

Next, as shown in FIGS. 6G and 5, a new stack 11A of sheets is loaded on the main lift 13 by the traverser 51. It must be pointed out here that the side faces of the old and newly loaded stacks 11 and 11A are not necessarily aligned with each other.

Thereafter, as shown in FIG. 6H, the main lift 13 is moved upwardly until the uppermost sheet of the newly loaded stack 11A is slightly below the spits 29. Next, the sheet pressing devices 34 on both sides are advanced to abut against the side faces of the old and newly loaded stacks 11 and 11A, and the transverse positions of the new stack 11A are adjusted. Such adjustment is done in the following manner. That is, as shown in FIG. 2, the sheet pressing devices 34 are advanced in the directions indicated by an arrow E. Then, the detecting member 39*a* of the lower limit switch 39 is brought into contact with the side faces of the newly loaded stack 11A and the lower limit switch 39 generates a detection signal. In response to this signal, the motor 19 is energized so that the bottom plate 18 is displaced in the direction indicated by the arrow E. In unison with this displacement, the sheet pressing devices 34 are also displaced in the same direction E. When the position of the old stack 11 coincides with the position of the newly loaded stack 11A, the detecting member 38*a* of the upper limit switch 38 is brought into contacts with the side faces of the old stack 11 so that the upper limit switch 38 generates a detection signal. In response to the reception of both the detection signals, the motor 19 is de-energized. Thus, the transverse side faces of the newly loaded stack 11A are adjusted. In case the newly loaded stack 11A is deviated to the right as viewed in FIG. 2 with respect to the old stack 11, it is the upper limit switch 38 that first generates a detection signal. In this case, the motor 19 is energized to displace the bottom plate 18 in the direction opposite to the direction indicated by the arrow E. When both the upper and lower limits switches 38 and 39 are actuated, the motor 19 is de-energized, whereby the position of the newly loaded stack 11A is determined.

Thereafter, as shown in FIG. 6I, the main lift 13 is moved upwardly and the lowermost sheet of the old stack 11 is caused to rest through the spits 29 upon the uppermost sheet of the newly loaded stack 11A. Then, the upward movement of the main lift 13 is so adjusted that the uppermost sheet is brought to a predetermined position with respect to the separator 14. The auxiliary lifts 41 are moved then downwardly to their initial positions.

Figure 6J:
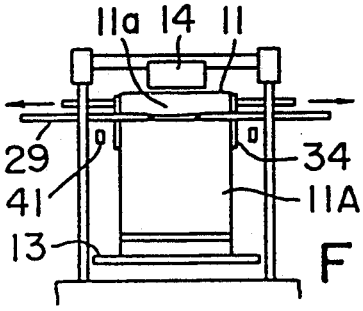

As shown in FIG. 6J, the sheet supporting spits 29 are thereafter withdrawn or retracted slowly in the right and left directions, respectively, so that the old stack 11 is mounted on the uppermost sheet of the newly loaded stack 11A. In this case, the sheet pressing devices 34 press both side faces of the stacks 11 and 11A so that there occurs no disorder of these stacks.

Figure 7:
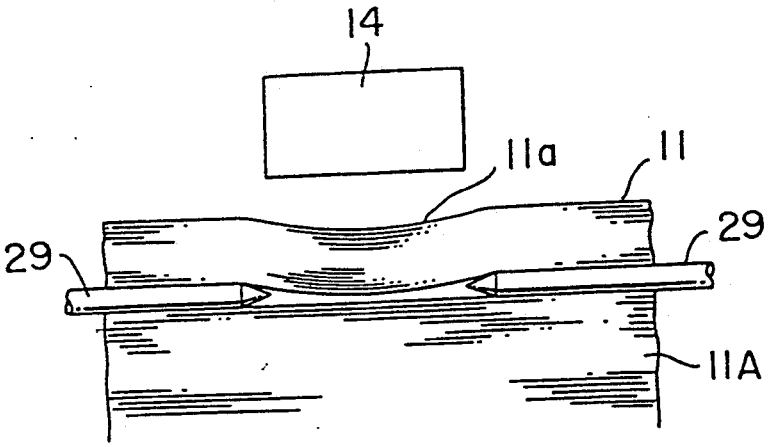
FIG. 7 is a fragmentary sectional view, on an enlarged scale, illustrating exaggeratedly withdrawal of a spit for supporting a stack of sheets.

As shown in FIG. 7, when the left and right spits 29 are withdrawn to the left and right respectively, the central portion 11*a* of the sheet stack 11 immediately below the separator 14 drops slowly since the both side portion of the stack 11 supported by the spits 29 are released gradually from the support by the spits 29. When the speed of withdrawal of the spits 29 is suitably selected, the central portion 11*a* of the uppermost sheet will not be suddenly separated from the separator 14. As a result, the failure of right feed (the failure of feeding sheets one by one) can be avoided.

After the spits 29 are withdrawn to the right and left, the sheet pressing devices 34 are returned to their initial positions, respectively, and the pneumatic cylinder 27 is energized so that the carriage 26 upon which are mounted the spits 29 and the sheet pressing devices 34 is moved downwardly to its initial position. Thus, the loading of a new stack 11A of sheet is accomplished.

According to the preferred embodiment of the present invention, the auxiliary lifts 41 which support the spits 29 through the carriages 26 is caused to move upwardly, but it is to be understood that the auxiliary lifts 41 may be so designed and constructed that they directly support the sheet supporting spits 29. Furthermore, so far the sheet supporting spits 29 have been described as being horizontally slidable with respect to the carriage 26, but it is also to be understood that the spits 29 may be securely attached to the carriage 26 and the vertical guide shaft 25 supporting the carriage 26 may be horizontally displaced so that the spits 29 may be reciprocated in the horizontal direction.

Moreover, according to the preferred embodiment, as shown in FIG. 5, in order to load a new stack 11A of sheets, the roller conveyors 50 are mounted on the main lift 13 and the traverser 51 and the stack stand 52 for placing thereon a plurality of stacks of sheets are disposed on the upstream side of the main lift 13, but it is to be understood that any other suitable mechanism may be used or a manually operated hand-lift or the like may be used.

As described above, according to the automatic sheet stack loading mechanism of the present invention, the sheet supporting spits are inserted from both sides of the path of feed of sheets so that even when the spits are deflected, the adjustment of the position of the sheet separator is not needed. When the sheet supporting spits are withdrawn from the interface between the lowermost sheet of the old stack of sheets and the uppermost sheet of the newly loaded stack of sheets, sudden drop of the central portion of the uppermost sheet in opposing relationship with the separator can be prevented so that sudden increase in gap between the separator and the uppermost sheet can be prevented and consequently the sheet feeding failure is avoided. The sheet pressing devices which may be additionally installed are effective in that when the spits are withdrawn, the mis-alignment of the side faces of the sheet stacks can be avoided. According to the present invention, it becomes possible to automate the operation of loading a new stack of sheets on the main lift, which operation was hitherto carried out only by a skilled operator, so that a new stack of sheets can be always loaded on the main lift without causing the sheet feed failure. Thus, the present invention can attain the effects of saving labors and improving productivity.

What is claimed is:

1. An automatic sheet stack loading mechanism of a sheet feeding apparatus, comprising:

a main lift adapted to support thereon a stack of sheets to be fed;

a sheet separator disposed over the main lift to act on the uppermost sheet of the stack of sheets so as to separate the sheets one by one from the stack, said main lift being movable upwardly to bring the uppermost sheet of the stack thereon to a predetermined height position relative to the sheet separator;

horizontally extending parallel spits for insertion under the stack of sheets supported by the main lift to support the load of the stack from below thereby to enable the main lift to be lowered to receive a new stack of sheets thereon while the uppermost sheet of said first stack is held at said predetermined height;

a pair of vertically movable carriages disposed at both sides of the main lift with respect to the direction transverse to the direction of feed of the sheets from said first stack, each of said carriages carrying thereon the parallel spits so that the parallel spits extend in said transverse direction and are shiftable toward and away from the stack on the main lift;

shifting means for shifting the spits toward and away from the stack on the main lift;

sheet stack aligning means disposed at both transverse sides of the main lift for aligning the side faces of the stacks; and motive power means for moving the aligning means towards and away from the stacks, said aligning means and said motive power means being mounted on the carriages.

2. An automatic sheet stack loading mechanism as in claim 1, wherein said sheet stack aligning means comprises:

a vertical member mounted on one of the carriages so as to be movable transversely toward and away from the side faces of the stacks carried on the spits and the main lift;

upper and lower stack detecting means carried on the vertical member for detecting the side faces of the stacks, respectively;

a bottom plate supported on the main lift to carry said new stack thereon, said bottom plate being movable transversely by a second motive power means; and wherein said second motive power means is activated when one of said stack detecting means detects the side face of one stack so as to transversely move said bottom plate to vertically align the two stacks, and wherein said second motive power means is deactivated when the other stack detecting means detects the side face of the other stack.

3. An automatic sheet stack loading mechanism as in claim 2, wherein said bottom plate has a rack and said second motive power means includes a motor with a pinion meshing with the rack.

4. An automatic sheet stack loading mechanism as in claim 2, wherein each of the carriages has a protrusion arranged so as to be abutted against from below by the main lift when the main lift moves upwardly, the protrusion being positioned to determine a preset relative height position between the spits and the stack of sheets on the main lift.

5. An automatic sheet stack loading mechanism as in claim 2, further comprising auxiliary lifts disposed adjacent to the carriages, respectively, for engaging the carriages to elevate the same together with the spits carried by the carriages so as to maintain the uppermost sheet of said first stack at said predetermined height position.

* * * * *